United States Patent [19]

Schaeffler

[11] Patent Number: 4,825,823

[45] Date of Patent: May 2, 1989

[54] SELF-ADJUSTING HYDRAULIC VALVE TAPPET

[75] Inventor: Georg Schaeffler, Herzogenaurach, Fed. Rep. of Germany

[73] Assignee: INA Walzlager Schaeffler KG, Fed. Rep. of Germany

[21] Appl. No.: 109,285

[22] Filed: Oct. 15, 1987

[30] Foreign Application Priority Data

Nov. 6, 1986 [DE] Fed. Rep. of Germany ..... 3637906

[51] Int. Cl.[4] ..... F01L 1/24

[52] U.S. Cl. ..... 123/90.55

[58] Field of Search ..... 123/90.55, 90.56, 90.57, 123/90.58, 90.59, 90.46, 90.63

[56] References Cited

U.S. PATENT DOCUMENTS 4,579,094 4/1986 Döppling et al. ..... 123/90.55

4,709,668 12/1987 Klug et al. ..... 123/90.55

FOREIGN PATENT DOCUMENTS 2758957 7/1979 Fed. Rep. of Germany ... 123/90.55

2935751 3/1981 Fed. Rep. of Germany ... 123/90.55

*Primary Examiner*—Andrew M. Dolinar

*Attorney, Agent, or Firm*—Bierman and Muserlian

[57] ABSTRACT

A self-adjusting hydraulic valve tappet arranged in a guide bore of a cylinder head of an internal combustion engine and comprising a cup-shaped housing (1) formed by a hollow cylindrical wall (2) closed at one end by an end member (3) against the outside of which a cam abuts and a guide sleeve (4) concentric with the hollow cylindrical wall (2) and extending at its end facing away from the end member (3) to the center of a disk member (5) connected with its outer circumference to the hollow cylindrical wall (2) of the housing (1) wherein the guide sleeve (4) is spaced from the end member (3) at its other end and guides the hydraulic play compensating element (6) for longitudinal movement thereof, characterized in that a second disk member (7) is provided which extends from the hollow cylindrical wall (2) and additionally supports the guide sleeve (4) at a distance from the first disk member (5).

10 Claims, 2 Drawing Sheets

SELF-ADJUSTING HYDRAULIC VALVE TAPPET

STATE OF THE ART

Figure 1:
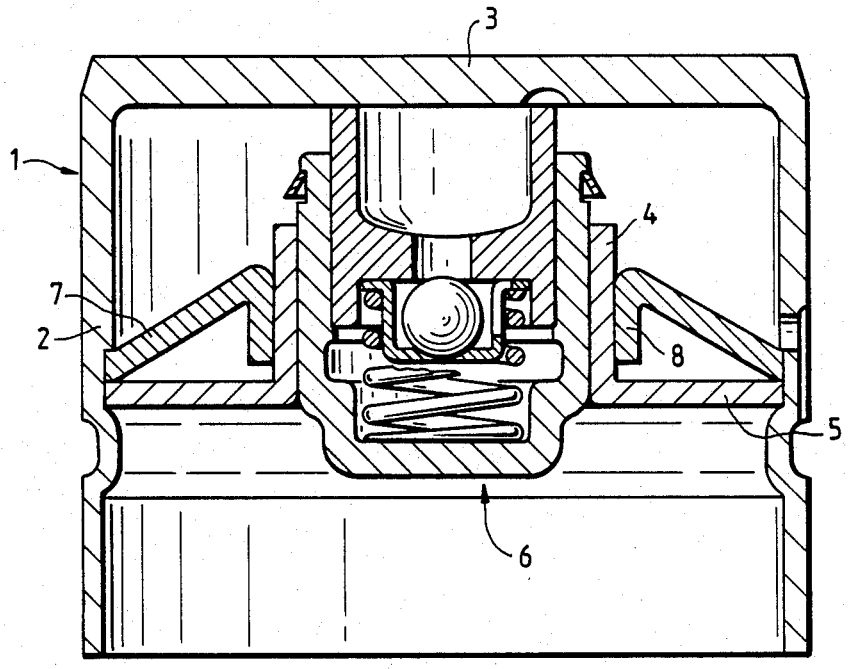

Self-adjusting hydraulic valve tappets arranged in a guide bore of a cylinder head of an internal combustion engine and comprising a cup-shaped housing formed by a hollow cylindrical wall closed at one end by an end member against the outside of which a cam abuts and a guide sleeve concentric with the hollow cylindrical wall and extending at its end facing away from the end member to the center of a disk member connected with its outer circumference to the hollow cylindrical wall of the housing wherein the guide sleeve is spaced at its other end from the end member and guides the actual play compensating element for longitudinal movement thereof are known from U.S. Pat. No. 4,590,898 for example which essentially are capable of meeting the set requirements. In connection with the continuous development of more powerful combustion engines running at high speed, valve tappets of the lowest possible mass are demanded but this in turn results in constructions of yet smaller wall thicknesses causing vibrations at high-frequency accelerations and decelerations during operation so that under unfavorable conditions, breaks and complete destruction of the valve tappet may be encountered. An especially crucial element is the guide sleeve which is connected to the cylindrical wall of the cup-shaped housing by a disk member only at its one end while its opposite end freely projects. If the guide sleeve and the disk member are also designed at thinner dimensions for reduction of the mass of the valve tappet, a critical situation is obtained with regard to vibrations.

OBJECTS OF THE INVENTION

It is an object of the invention to provide a novel self-adjusting hydraulic valve tappet with a simple suitable stiffening of the guide sleeve to prevent vibration damage even at reduced wall thicknesses.

This and other objects and advantages of the invention will become obvious from the following detailed description.

THE INVENTION

The novel self-adjusting hydraulic valve tappet of the invention arranged in a guide bore of a cylinder head of an internal combustion engine and comprising a cup-shaped housing (1) formed by a hollow cylindrical wall (2) closed at one end by an end member (3) against the outside of which a cam abuts and a guide sleeve (4) concentric with the hollow cylindrical wall (2) and extending at its end facing away from the end member (3) to the center of a disk member (5) connected with its outer circumference to the hollow cylindrical wall (2) of the housing (1) wherein the guide sleeve (4) is spaced from the end member (3) at its other end and guides the hydraulic play compensating element (6) for longitudinal movement thereof, is characterized in that a second disk member (7) is provided which extends from the hollow cylindrical wall (2) and additional supports the guide sleeve (4) at a distance from the first disk member (5)

By providing a second disk member which extends from the hollow cylindrical wall and additionally supports the guide sleeve at a distance from the first disk member, a box-type shape is created which is of considerably greater stiffness even at considerably reduced wall thickness in comparison to conventional tappet constructions.

To prevent an inadmissable reduction of the outer annular oil reservoir in such a design, it is suitable to connect the second disk member with the hollow cylindrical wall in the immediate proximity of the first disk member wherein the second disk member extends therefrom in a funnel-shape manner in the direction toward the end member and engages the guide sleeve in the vicinity of its end facing the end member. In this context it may be preferable to provide the second disk member at its bore with a collar which receives the guide sleeve in its bore. The use of any additional fastening means is avoided by providing a close fit between the guide sleeve, on the one hand, and the axial collar, on the other hand. It is also possible, if necessary, to connect the second disk member with the guide sleeve through welding, soldering, gluing or the like. According to a further design, the second disk member is suitably provided in one piece with the guide sleeve.

To achieve an even more rigid support of the guide sleeve, both disk members may extend at a distance from each other approximately perpendicular to the longitudinal axis of the valve tappet and extend integrally connected from both ends of the guide sleeve.

Figure 2:
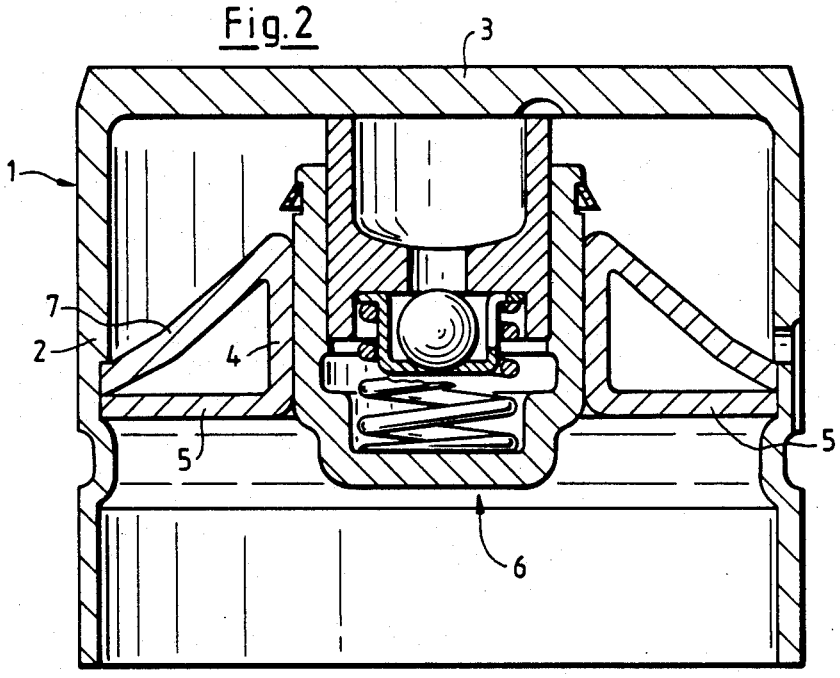
Figure 3:
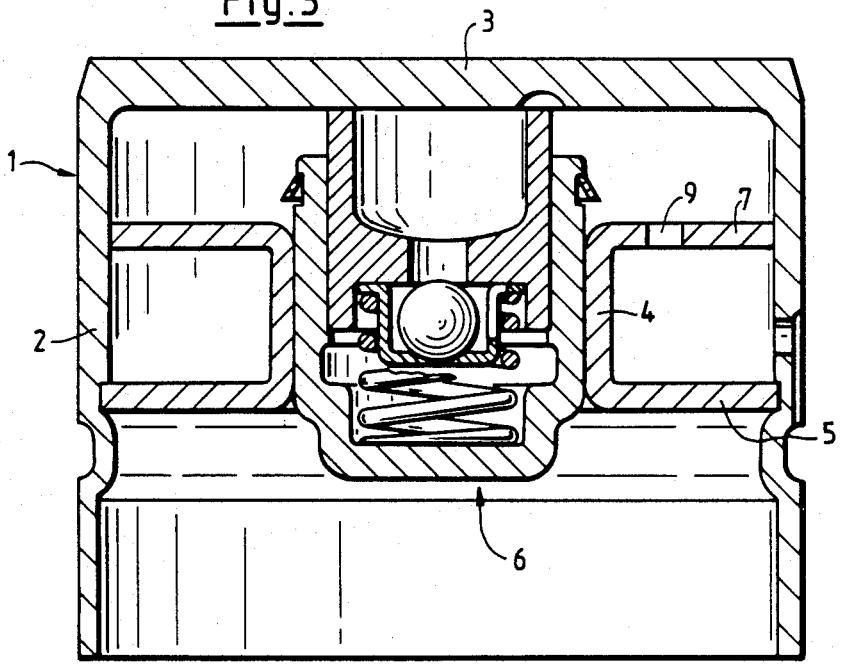

Referring now to the drawings:

FIGS. 1 to 3 are cross-sectional view of there different embodiments of the valve tappet of the invention.

Each of the tappets illustrated in FIGS. 1 to 3 has a cup-shaped housing 1 formed by the hollow cylindrical wall 2 and the end member 3 made of a single piece with the latter and arranged concentrically within the housing 1 is the guide sleeve 4 which extends at its end facing away from the end member 3 to the center of a first disk member 5 which in turn is connected to the hollow cylindrical wall 2. The actual hydraulic play compensating element 6 is guided for longitudinal movement within the guide sleeve 4. A second disk member 7 is provided in addition to the first disk member and is connected to the hollow cylindrical wall 2 in the immediate proximity of the first disk member 5 as shown in the embodiments of FIGS. 1 and 2.

According to FIG. 1, the second disk member 7 is provided at its bore with an axially directed collar 8, the inner diameter of which is selected with regard to the outer diameter of the guide sleeve 4, so that a close fit is provided therebetween. The embodiment in FIG. 2 differs from this embodiment in that the second disk member 7 is provided in one piece with the guide sleeve 4. While the first disk member 5 extends from the lower end of the guide sleeve 4, the second disk member 7 extends slantingly outwardly from the upper end of the guide sleeve 4 and is connected in the immediate proximity of the first disk member 5 to the hollow cylindrical wall 2.

Finally, FIG. 3 illustrates a further modification in which, similar to FIG. 2, the first disk member 5 extends from the lower end of the guide sleeve 4 while the second disk member 7 extends from the upper end thereof. In contrast to FIG. 2, however, both disk members 5 and 7 extend outwardly perpendicular to the longitudinal axis of the valve tappet and are connected to the hollow cylindrical wall 2 at two axially spaced areas. In this manner, a box-shaped construction is obtained which is of even greater stiffness than the previously described one. To prevent a reduction of the external annular oil reservoir, the second disk member 7 is provided with a bore 9 which connects both partial reservoirs separated from each other by the second disk member 7.

Various modifications of the valve tappet of the invention may be made without departing from the spirit or scope thereof and it is to be understood that the invention is to be limited only as defined in the appended claims.

What I claim is:

1. A self-adjusting hydraulic valve tappet arranged in a guide bore of a cylinder head of an internal combustion engine and comprising a cup-shaped housing (1) formed by a hollow cylindrical wall (2) closed at one end by an end member (3) against the outside of which a cam abuts and a guide sleeve (4) concentric with the hollow cylindrical wall (2) and extending at its end facing away from the end member (3) to the center of a disk member (5) connected with its outer circumference to the hollow cylindrical wall (2) of the housing (1) wherein the guide sleeve (4) is spaced from the end member (3) at its other end and guides the hydraulic play compensating element (6) for longitudinal movement thereof, characterized in that a second disk member (7) is provided which extends from the hollow cylindrical wall (2) and additionally supports the guide sleeve (4) at a distance from the first disk member (5).

2. A valve tappet of claim 1 wherein the second disk member (7) is connected to the hollow cylindrical wall (2) in immediate proximity of the first disk member (5) and extends therefrom in a funnel-shape manner in the direction toward the end member (3) and engages the guide sleeve (4) in the vicinity of its end facing the end member (3).

3. A valve tappet of claim 1 wherein the second disk member (7) is connected at its bore to an axial collar (8) which receives the guide sleeve (4) in its bore.

4. A valve tappet of claim 2 wherein the second disk member (7) is connected at its bore to an axial collar (8) which receives the guide sleeve (4) in its bore.

5. A valve tappet of claim 1 wherein the second disk member (7) is fixedly connected with the guide sleeve (4).

6. A valve tappet of claim 5 wherein the fixed connection is by welding, soldering or gluing.

7. A valve tappet of claim 1 wherein the second disk member (7) and the guide sleeve (4) are provided in one piece.

8. A valve tappet of claim 2 wherein the second disk member (7) and the guide sleeve (4) are provided in one piece.

9. A valve tappet of claim 1 wherein both disk members (5,7) extend at a distance from each other approximately perpendicular to the longitudinal axis of the valve tappet and extend integrally connected from both ends of the guide sleeve (4).

10. A valve tappet of claim 5 wherein both disk members (5,7) extend at a distance from each other approximately perpendicular to the longitudal axis of the valve tappet and extend integrally connected from both ends of the guide sleeve (4).

* * * * *